US009199764B2

(12) United States Patent
Smolenaers

(10) Patent No.: US 9,199,764 B2
(45) Date of Patent: Dec. 1, 2015

(54) LOAD BEARING STRUCTURE

(71) Applicant: Unitload Pty Ltd, Subiaco (AU)

(72) Inventor: Peter Smolenaers, Hawthorn East (AU)

(73) Assignee: Unitload Pty Ltd, Subiaco (AU)

( * ) Notice: Subject to any disclaimer, the term of this patent is extended or adjusted under 35 U.S.C. 154(b) by 0 days.

(21) Appl. No.: 14/498,110

(22) Filed: Sep. 26, 2014

(65) Prior Publication Data

US 2015/0047537 A1 Feb. 19, 2015

Related U.S. Application Data

(63) Continuation of application No. 14/239,232, filed as application No. PCT/AU2012/000932 on Aug. 7, 2012, now Pat. No. 8,869,674.

(30) Foreign Application Priority Data

Aug. 18, 2011 (AU) ..... 2011903311
Apr. 19, 2012 (AU) ..... 2012901541

(51) Int. Cl.
*B65D 19/38* (2006.01)
*B65D 19/40* (2006.01)
*B65D 19/00* (2006.01)

(52) U.S. Cl.
CPC ..... *B65D 19/40* (2013.01); *B65D 19/0004* (2013.01); *B65D 19/0016* (2013.01); *B65D 2203/10* (2013.01); *B65D 2519/00024* (2013.01); *B65D 2519/00059* (2013.01); *B65D 2519/00094* (2013.01); *B65D 2519/00273* (2013.01); *B65D 2519/00288* (2013.01); *B65D 2519/00303* (2013.01);

(Continued)

(58) Field of Classification Search
CPC ..... B65D 2519/00024; B65D 2519/00064; B65D 2519/00094; B65D 2519/00164; B65D 2519/0023; B65D 2519/00303; B65D 2519/003583
USPC ..... 108/57.29, 27.31, 27.18, 27.32, 57.17, 108/51.11, 57.33, 57.3, 57.21, 57.22, 57.14, 108/57.25, 57.31, 57.18
See application file for complete search history.

(56) References Cited

U.S. PATENT DOCUMENTS 2,692,107 A 10/1954 De Ridder
3,602,157 A 8/1971 Cohen et al.

(Continued)

FOREIGN PATENT DOCUMENTS

CA 1278754 C 1/1991
CA 2036526 A1 8/1992

(Continued)

OTHER PUBLICATIONS

Deshmukh, Rajeev, "International Search Report," prepared for PCT/AU2012/000932, as mailed Oct. 17, 2012, 7 pages.

(Continued)

*Primary Examiner* — Jose V Chen
(74) *Attorney, Agent, or Firm* — Winstead PC

(57) ABSTRACT

A pallet including a deck, a frame and one or more elements. The deck is for carrying cargo. The frame is about a perimeter of the pallet and is formed of horizontally extending tubular portions. The elements support the frame above a support surface to overlie one or more openings for receiving the tines of a lifting device. The tubular portions include lengthwise corrugations.

20 Claims, 5 Drawing Sheets

(52) U.S. Cl.
CPC ..... *B65D 2519/00323* (2013.01); *B65D 2519/00333* (2013.01); *B65D 2519/00373* (2013.01); *B65D 2519/00407* (2013.01); *B65D 2519/00412* (2013.01); *B65D 2519/00417* (2013.01); *B65D 2519/00562* (2013.01)

(56) References Cited

U.S. PATENT DOCUMENTS

| | | | | |
|---|---|---|---|---|
| 3,616,766 | A | 11/1971 | Weiss | |
| 3,756,167 | A | 9/1973 | Wilson | |
| 3,861,326 | A | 1/1975 | Brown | |
| 4,424,752 | A | 1/1984 | Aberg | |
| 4,485,744 | A | 12/1984 | Umemura et al. | |
| D335,743 | S | 5/1993 | Nordstrom | |
| 5,367,960 | A | 11/1994 | Schleicher | |
| 5,460,103 | A | 10/1995 | Dunn et al. | |
| 5,687,653 | A | 11/1997 | Bumgarner | |
| 5,809,907 | A | 9/1998 | Bumgarner | |
| 6,708,628 | B2 | 3/2004 | Halavais | |
| 6,745,703 | B2 | 6/2004 | Torrey et al. | |
| 7,013,814 | B2 | 3/2006 | Modesitt et al. | |
| 7,987,796 | B2 | 8/2011 | Nordstrom | |
| 7,987,798 | B2 | 8/2011 | Kim | |
| D645,635 | S | 9/2011 | Moore | |
| 8,077,040 | B2 | 12/2011 | Muirhead | |
| 8,146,516 | B2 | 4/2012 | Linares | |
| 8,863,674 | B2 * | 10/2014 | Smolenaers | 108/51.11 |
| 2007/0108296 | A1 | 5/2007 | Konopka et al. | |
| 2007/0245932 | A1 | 10/2007 | Nielsen | |
| 2008/0143514 | A1 | 6/2008 | Valentinsson | |
| 2009/0101049 | A1 | 4/2009 | Lee | |

FOREIGN PATENT DOCUMENTS

| | | | |
|---|---|---|---|
| CN | 2436440 | Y | 6/2001 |
| CN | 2518783 | Y | 10/2002 |
| CN | 101033020 | A | 9/2007 |
| EP | 0049033 | A1 | 4/1982 |
| GB | 609769 | A | 10/1948 |
| GB | 1391472 | A | 4/1975 |
| JP | 2003118734 | A | 4/2003 |
| JP | 2004359327 | A | 12/2004 |
| JP | 2005035650 | A | 2/2005 |
| JP | 2005096804 | A | 4/2005 |
| JP | 2007210624 | A | 8/2007 |
| WO | WO-92/12905 | A1 | 8/1992 |
| WO | WO-9214654 | A1 | 9/1992 |
| WO | WO-9406693 | A1 | 3/1994 |
| WO | WO-2008002007 | A1 | 1/2008 |
| WO | WO-200902998 | A1 | 3/2009 |
| WO | WO-2011160224 | A1 | 12/2011 |

OTHER PUBLICATIONS

Stratco, Design Guide, "Stratco Roofing Battens," Feb. 2005, 2 pages.
Images from Steel Pallet Systems' website, Jun. 29, 2011, 1 page.
Intelligent Global Pooling Systems, "Pallet Features and Specifications," Jun. 26, 2011, 2 pages.
Costco Wholesale, "Structural Packaging Specifications," Aug. 1, 2010, 4 pages.
Wisconsin Wire Works Inc., "Welding Galvanized Steel with Wisconsin Wire Works SIL-WELD Silicon Bronze," Jun. 27, 2011, 4 pages.
Covel, Ron, "Using Silicon Bronze Filler Rod on Steel," Metalshapers Association, 2007, 1 page.
http://www.steelpacpallets.com/steelpallets.html, "Steelpac Pallets are Tougher," Dec. 17, 2010, 2 pages.
http://www.steelpacpallets.com/steelpalletsdevelopment.html, "Steelpac Pallets Design and Development," Jan. 6, 2011, 2 pages.
http://steelpacpallets.com, "A Closer Look: Pallet Comparison," Feb. 7, 2011, 1 page.
http://steelpacpallets.com, "Who's Using Steel Pallets," Feb. 7, 2011, 4 pages.
http://www.steelpacpallets.com/steelpalletscomparisons.html, "Ordinary Pallets Just Don't Stack Up," Dec. 17, 2010, 2 pages.
http://www.steelpacpallets.com/steelpacusers.html, "Steelpac Pellets—On the Job," Dec. 17, 2010, 2 pages.
http://www.steelpacpallets.com/steelpaccontact.html, "Steelpac Pallets—Here to Help," Dec. 17, 2010, 1 page.
http://steelpacpallets.com, "Steelpac Pallets—Contact Us," Feb. 7, 2011, 1 page.
https://web.archive.org/web/20110422142937/http://www.gaa.com.au/design_for_galvanizing/design4.pdf, "Welding Galvanized Steel," 2011, 5 pages.
http://www.sperkoengineering.com/html/articles/Welding-Galvanized.pdf, "Welding Galvanized Steel—Safely," Sperko Engineering Services, Inc., 1999, 6 pages.
http://www.brazing.com/PDF/Copper%20Data%20Sheets/C656%20(Silicon%20Bronze).pdf, "Silicon Bronze," Aufhauser Corporation, as viewed by Applicant on Jun. 29, 2011, 2 pages.
http://www.wisconsinwireworks.com/pdfs/msds.pdf, "Material Safety Data Sheet," Mar. 2, 2011, 2 pages.
http://en.wikipedia.org/w/index.php?title=Brazing&oldid=436465303, "Brazing," Jun. 27, 2011, 13 pages.

* cited by examiner

LOAD BEARING STRUCTURE

CROSS-REFERENCE TO RELATED APPLICATIONS

This application is a continuation of, and incorporates by reference for any purpose the entire disclosure of, U.S. patent application Ser. No. 14/239,232, which application entered the U.S. national stage under 35 U.S.C. 371 on Feb. 17, 2014. U.S. patent application Ser. No. 14/239,232 is a national stage of PCT/AU2012/000932, filed on Aug. 7, 2012. PCT/AU2012/000932 claims priority to Australian Patent Application No. 2011903311, filed Aug. 18, 2011 and Australian Patent Application No. 2012901541, filed Apr. 19, 2012. PCT/AU2012/000932, Australian Patent Application No. 2011903311, and Australian Patent Application No. 2012901541 are incorporated herein by reference.

FIELD OF THE INVENTION

Various aspects of the invention relate to load bearing structures, such as pallets, frames and members, and identifying and tracking load bearing structures and other items, and bonding sheet material to form load bearing structures and other items.

A "pallet", as the term is used herein, is a horizontal structure for carrying loads such as boxed groceries at an elevation above a support surface (e.g. the ground) so as to define opening(s) into which the tines of a lifting device (e.g. a forklift) are receivable to lift the pallet and the load carried thereby.

An "elongate member", as the term is used herein, is a member which is much longer (say at least two times) longer than it is wide.

BACKGROUND

It is generally desirable that a load bearing structure should be strong and light. Light weight structures typically include less material (and so potentially lower material costs) and are usually easier and safer to construct and handle. In the case of transportable load bearing structures, such as pallets, lighter weight leads to significant fuel savings.

It is also generally desirable that load bearing structures should be robust. Pallets are routinely exposed to rough handling. By way of example, forklift drivers routinely use the pointed ends of forklift tines to nudge loaded pallets into place rather than lifting and replacing the pallet which is more difficult and time consuming.

At present wooden pallets are popular. Plastic pallets and steel pallets are also available. Plastic pallets are thought to be not strong enough for racking. Racking involves the pallet bridging a space between two parallel rails of a rack. Steel pallets are thought to be strong but expensive and heavy.

A typical wooden pallet includes two horizontal arrays of parallel horizontal planks respectively defining a top and bottom deck. The planks are typically in the vicinity of 20 mm thick. A horizontal array of three parallel horizontal beams sits between and spaces the decks. The beams are typically each about 100 mm high by about 50 mm wide. Thus the pallet is about 140 mm high and includes a pair of about 100 mm high tine receiving voids defined between the beams.

Such wooden pallets are heavy. Moreover the planks of the bottom deck present an impediment to the insertion of the wheeled tines of certain lifting devices. A powerful user of pallets now specifies that the bottom deck must include a chamfered edge to aid with the insertion of wheeled tines.

Corrosion reduces the life of metallic load bearing structures. The effects of corrosion can be reduced by employing a rust inhibiting coating.

Galvanised steel is steel with a zinc (or zinc based) rust inhibiting coating. The coating serves to both directly shield the steel from corrosive elements and to electrochemically protect the steel. There a variety of methods for applying the coating, e.g. the steel might be hot dipped or electrochemically treated.

Galvanised steels are not well suited to welding or other forms of energetic bonding such as brazing. Typically the zinc coating is destroyed at and about the weld site. The weld sites are thus prone to corrosion unless treated post welding, e.g. by painting the weld sites with a zinc rich paint. This treatment adds cost.

Some load bearing structures are made up of sheet metal. By way of example, some house frames are made up of elongate open channel sections formed of sheet metal.

Sheet material is not always well suited to energetic bonding. Sheet material, and especially thin sheet material, can be "burnt away" when attempting to form an energetic bond. This is especially so at the edges of the sheets.

The properties of sheet metal depend on how it is processed. Cold rolled steel is stronger than steel rolled in a semi molten state and thus is sometimes referred to as high tensile steel. Cold rolled steel is typically only available in thicknesses up to 1 mm.

An existing metal pallet includes a construction which mirrors that of typical wooden pallets. Its top and bottom decks are formed of galvanised sheet metal with corrugations in the vicinity of 20 mm high. Its beams are made up of formed galvanised sheet. Such metal pallets are thought to be heavy and, like typical wooden pallets, to present an impediment to the insertion of wheeled tines.

A further disadvantage of using metal in the construction of pallets arises when endeavoring to use Radio Frequency Identification (RFID) tags to identify and track the pallets. RFID tags emit a radio frequency signal in response to an interrogation signal from an RFID tag reader. The emitted signal can uniquely identify the pallet and/or carry other information about pallet and/or its contents. The present inventor has discovered that certain RFID tags do not work when mounted against certain metallic structures.

The invention aims to at least partly address one or more of the above problems, or at least to provide an alternative in the marketplace.

SUMMARY

One aspect of the invention provides a pallet including a deck for carrying cargo; and a frame about a perimeter of the pallet, the frame being formed of horizontally extending tubular portions;

one or more elements for supporting the frame above a support surface to overlie one or more openings for receiving the tines of a lifting device;

wherein the tubular portions include lengthwise corrugations.

Preferably the lengthwise corrugations are inwardly directed such that the tubular portions outwardly present aligned planar portions without intermediate projections to suit mating with other components.

In preferred forms of the pallet each of the tubular portions substantially consists of formed sheet material. In this case most preferably two edges of the sheet material of each of the tubular portions each include a respective fold (e.g. return fold); and each fold of each respective tubular portion is energetically bonded to the other fold of the respective tubular portion to define a seam. The energetically bonding is preferably brazing with a filler material having a melting point of less than about 1150° C.

Lengthwise corrugations in the range of 4 mm to 6 mm high are preferred, and it is also preferred that the corrugations are spaced at a pitch of less than about 20 mm. By way of example, pitch may be in the range of 12 mm to 20 mm.

Optionally each of the tubular portions has a cross-section including vertical spaced horizontal portions which each include at least one of the lengthwise corrugations.

Two or more elements preferably define upwardly diverging load paths such that weight carried by the pallet tensions one or more of the tubular portions.

Preferably the tubular portions at least predominantly consist of metal, most preferably cold rolled steel.

In variants of the pallet having an elongate member underlying at least one of the openings, the elongate member preferably includes a body having lengthwise corrugations. Each side of the body may respectively include a portion formed to overlap a portion of the body. Preferably the overlapping portion is fastened along its length to the body.

The pallet preferably includes a non-metallic, e.g. plastic, member carrying an RFID tag. By way of example, the RFID tag may be adhesively bonded to the non-metallic member. Alternatively, the RFID tag may be embedded in the non-metallic member. The RFID tag is preferably in substance at least 2 mm, or more preferably at least 10 mm, from the nearest metal.

Another aspect of the invention provides an item, e.g. a pallet, at least predominantly formed of metal including a non-metallic member carrying an RFID tag. Preferably the RFID tag is adhesively bonded to the non-metallic member. The non-metallic member is preferably plastic. The RFID tag is preferably in substance at least 2 mm, or more preferably at least 10 mm, from the nearest metal.

Another aspect of the invention provides an elongate member, for bearing loads, formed of a web of material including lengthwise corrugations less than about 6 mm high.

The corrugations are preferably in the range of 4 mm to 6 mm high, and most preferably spaced at a pitch of less than about 20 mm; e.g. spaced at a pitch in the range of 12 mm to 20 mm.

The member may include a body having two sides; and a respective wall projecting from each side of the body to define an open channel;

wherein at least one of the body and the respective walls includes the lengthwise corrugations.

Preferably the body includes the lengthwise corrugations.

Alternatively, the member may include an elongate body including the lengthwise corrugations and having two sides; and at at least one of the sides a portion formed to overlap a portion of the body.

Another aspect of the invention provides an elongate member, for bearing loads, formed of a web of material including a body having two sides; and a respective wall projecting from each side of the body to define an open channel;

wherein at least one of the walls includes lengthwise corrugations.

According to preferred forms of the invention the walls are substantially perpendicular to the body.

Another aspect of the invention provides an elongate member, for bearing loads, formed of a web of material including a body having two sides; and a respective wall projecting from each side of the body to define an open channel;

wherein at least one of the body and the respective walls includes lengthwise corrugations; and the walls are substantially perpendicular to the body.

Each of the walls preferably include lengthwise corrugations.

Another aspect of the invention provides an elongate member, for bearing loads, formed of a web of material and including an elongate body including lengthwise corrugations and having two sides; and at at least one of the sides, or more preferably each of the sides, a portion formed to overlap a portion of the body.

The overlapping portion(s) are optionally fastened along their length to the body.

The members may at least predominantly consist of metal such as cold rolled steel. The members may include a rust inhibiting coating. Preferably corrugations project from one face of the web, the other face of the web being free of projecting corrugations for connection to other members.

Another aspect of the invention provides a pallet including at least one of the members.

Within the pallet, the member may be a horizontally extending member supported by one or more elements above a support surface to overlie one or more openings for receiving the tines of a lifting device. The horizontally extending member preferably includes an upwardly projecting portion shaped to cooperate with an upwardly adjacent like pallet for aligned stacking and most preferably supports a deck for carrying cargo.

Another aspect of the invention provides a pallet including a deck for carrying cargo; and a horizontally extending member and one or more elements for supporting the horizontally extending member above a support surface to overlie one or more openings for receiving the tines of a lifting device;

wherein the horizontally extending member supports the deck and includes an upwardly projecting portion shaped to cooperate with an upwardly adjacent like pallet for aligned stacking.

The horizontally extending member may at least predominantly consist of a web of material and have one or more lengthwise corrugations. Optionally the first horizontally extending member is fastened along its length to the deck.

Preferably at least a region of the decking at least predominantly consists of vertical webs of material. Horizontally extending strips of metal may define the vertical webs of material. At least an upper edge of each said strip may be formed to stiffen the strip. Preferably the vertical webs of material define cells.

The one or more elements preferably define upwardly diverging load paths such that weight carried by the pallet tensions the horizontally extending member.

Another aspect of the invention provides a pallet including a horizontally extending member and one or more elements for supporting the horizontally extending member above a support surface to define one or more openings for receiving the tines of a lifting device;

wherein the one or more elements define upwardly diverging load paths such that weight carried by the pallet tensions the horizontally extending member.

Preferably the pallet includes a metallic portion having a rust inhibiting coating and at least one brazed joint including a filler material having a melting point of less than about 1150° C.

Another aspect of the invention provides a pallet including a metallic portion, which portion has a rust inhibiting coating and at least one brazed joint including a filler material having a melting point of less than about 1150° C. Preferably the filler material is at least 50%, or most preferably about 63%, copper.

Another aspect of the invention provides a frame, for bearing loads, including one of the above members.

The frame may be a truss and/or at least a portion of a house frame.

Another aspect of the invention provides a method of connecting sheet material to further material including folding along an edge of the sheet material;

relatively positioning an exterior of the fold and the further material; and energetically bonding the exterior of the fold to the further material.

The fold is preferably a return fold.

The further material may also be sheet material in which case the method may further include folding the further material to form a fold, and the relative positioning and the energetically bonding may be to an exterior of the fold of the further material.

The energetically bonding is preferably brazing with a filler material having a melting point of less than 1150° C. The sheet material and the further material are preferably metallic.

Another aspect of the invention provides a pallet including a deck for carrying cargo; and a frame about a perimeter of the pallet, the frame being formed of horizontally extending tubular portions;

one or more elements for supporting the frame above a support surface to overlie one or more openings for receiving the tines of a lifting device;

wherein each of the tubular portions substantially consists of formed sheet material;

two edges of the sheet material of each of the tubular portions each include a respective fold; and each fold of each respective tubular portion is energetically bonded to the other fold of the respective tubular portion to define a seam.

The folds are preferably return folds.

The energetically bonding is preferably brazing with a filler material having a melting point of less than about 1150° C.

BRIEF DESCRIPTION OF THE DRAWINGS

The Figures illustrate various exemplary arrangements.

DESCRIPTION OF AN EMBODIMENT

FIGS. 1 to 7 illustrate a pallet 10 in accordance with a preferred embodiment of the invention. The pallet 10 includes a decking 12 supported by a support frame 14.

The frame 14 includes four top chords 14A, 14B, 14C, 14D. Each top chord is an elongate member more than five times longer than it is wide. The top chords are arranged end to end at right angles to define a rectangular perimeter frame. The top chords directly underlie to support the decking.

The top chords 14A, 14B, 14C, 14D are supported at an elevation above the ground by elements including elements 14H, 14I, 14J, 14K, 14L, 14M (see FIG. 4) to define tine receiving openings 13. The illustrated pallet includes a respective pair of tine receiving openings 13 on each of its four side faces so that a forklift (or other lifting device) may approach the pallet 10 from any direction to lift the pallet, i.e. the pallet 10 is a "four-way pallet".

Four bottom chords 14E, 14F, 14G, 14H are arranged end to end at right angles to define a rectangular perimeter frame about the lower extent of the pallet 10.

A longitudinally extending central support member 14T extends from a center point of the forward top chord 14C to a centre point of the rear top chord 14A.

Elongate support members 14P extend transversely to respectively connect the centres of the side mounted top chords 14B, 14D to the lengthwise centre of support member 14T. Secondary elongate support members 14R, 14S extend transversely, to interconnect the top side chords 14B, 14D to the member 14T, in the spaces fore and aft of the central support member 14P. The support members 14P, 14R, 14S and 14T directly underlie and further support the decking 12.

A further elongate member 14Q extends transversely to connect the centre points of the side mounted bottom chords 14F, 14H.

It will be appreciated that the top chords 14A, 14B, 14C, 14D and supports 14P, 14R, 14S, 14T form a top frame portion, and that the bottom chords 14E, 14F, 14G, 14H and elongate member 14Q define a bottom frame portion, and that the top frame portion is held above the bottom frame portions by the elements including elements 14H to 14M.

Figure 6:
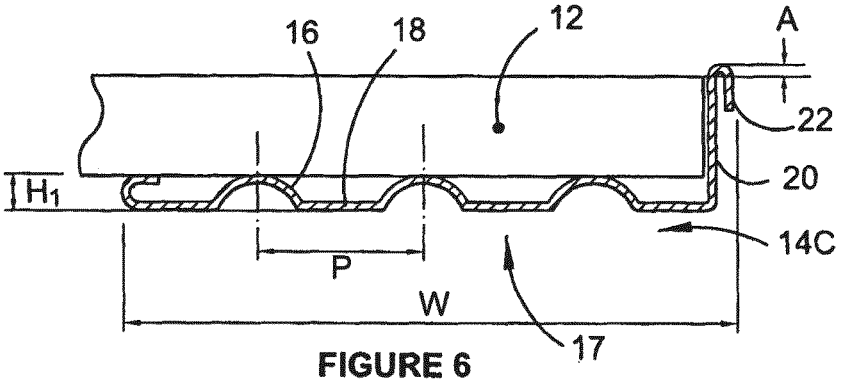
FIG. 6 is a transverse cross-section view of a top chord of the pallet.

FIG. 6 is a transverse cross-section view of the top chord 14C. Each of the other top chords 14A, 14B, 14D have a like cross-section. The top chord 14C is formed of 0.75 mm thick cold rolled steel which has been roll formed to the illustrated shape. The chord 14C includes a horizontal floor 17 and an upwardly projecting portion in the form of vertical side wall 20. The side wall 20 terminates in a downward return 22 consisting of an end portion of the sheet material having been bent outwardly by 180° to extend downwardly. The downward return 22 creates a smooth rounded upper edge instead of the potentially sharp free edge of the sheet material. Moreover the return 22 adds a significant strength to the chord 14C.

The floor 17 is corrugated. The corrugations run parallel to the length of top chord 14C; i.e. are lengthwise corrugations. A corrugation is an elongate formation formed in a web of material which is superimposed on without substantially changing the overall shape of the material. By way of example, conventional corrugated roofing sheets may have a generally sinusoidal corrugation profile superimposed on but not changing the generally planar shape of the sheet.

The floor 17 includes a corrugation pattern having upwardly projecting curved portions 16 between flat portions 18. It will be observed that the flat portions 18 are horizontally aligned with portions of the floor 17 outside of the corrugation pattern. The portions 16 project upwardly whereby the downward face of the chord 14C is substantially planar for welding, or otherwise fastening, to other members.

In this embodiment the corrugations are spaced at a pitch P of about 20 mm and have a height $H_1$ of 5 mm. The height is measured from the uppermost and lowermost points of the corrugation. Each corrugation portion 16 is preferably in the vicinity of 6 to 12 mm wide.

The inventor has surprisingly discovered that corrugations of this magnitude, or even smaller, dramatically increase the load bearing characteristics of the top chord 14C. The inventor's tests have shown that the illustrated top chord is stronger than, but weighs no more than, a like chord formed of 1 mm thick cold rolled steel lacking corrugations, also surprisingly, the inventor has discovered that the illustrated top chord 14C uses significantly less material than an equivalent strength top chord lacking corrugations. As such, by introducing such ultra low corrugations the strength to weight ratio (and indeed the strength to material cost ratio) of the elongate member can be improved. Indeed finite element analysis has shown that a short planar member formed of 0.75 thick steel including the described corrugations weighs about the same but is almost 6 times stronger than a 1 mm thick simple planar sheet lacking corrugations (when load is applied to bend the material about an axis parallel to its plane and perpendicular to the corrugations).

The decking 12 sits atop the upwardly curved portions 16 of the floor 17 and within the bounds of the wall 20. The wall 20 projects upwardly beyond the decking 12 by a distance A to define a lip co-operable with the bottom chords of an upwardly adjacent like pallet for aligned stacking; i.e. the bottom chords of the upwardly adjacent like pallet nest within the bounds of the wall 20 and sit atop the decking 12. Thus the upwardly projecting portion 20 facilitates registration of vertically adjacent pallets to create neatly formed and secure stacks of pallets. Dimension A, i.e. the height of the lip, is preferably 2 to 10 mm. The chord 14C is about 75 mm wide (dimension W). The side toward the left of FIG. 6 terminates in an upward 180° return fold. The fold is the same height as the portions 16 and so contacts the decking 12. The fold supports the decking and strengthens the chord 14C.

Figure 7:
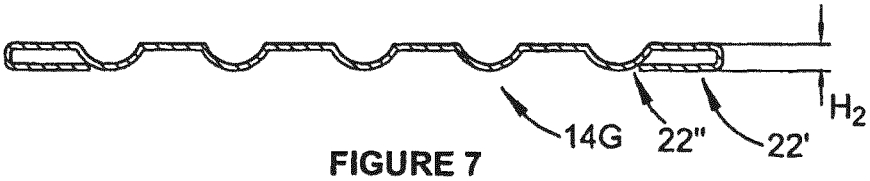
FIG. 7 is a transverse cross-section view of a bottom chord of the pallet.

FIG. 7 illustrates a bottom chord 14G which consists of a web of 0.75 mm thick cold rolled steel formed to have the same corrugation pattern as the top chord 14C. The chord 14G is about 130 mm wide. At each side of the chord 14G a return fold 22' is formed so that a short portion of the web material overlaps the main body of the chord 14G. The inventor has found that surprisingly this small return fold greatly enhances the strength of the chord. The inventor has further discovered that the strength can be further improved by brazing or otherwise fastening the overlapping portion to the body portion. In FIG. 7 the return fold is brazed to an upwardly projecting corrugation adjacent the edge along a seam 22". Thus the return fold 22', the overlapped portion of the body and the corrugation thus define a tubular portion to add significant strength to the member 14G.

The bottom chord 14G is in the vicinity of 5 mm thick and so substantially overcomes difficulties associated with inserting wheeled tines. Advantageously the corrugations project downwardly leaving aligned upward facing planar portions.

Figure 8:
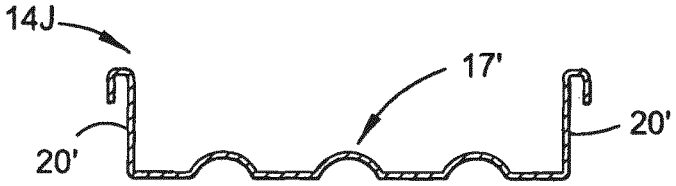
FIG. 8 is a transverse cross-section view of a support element.

FIG. 8 illustrates a transverse cross-section view of the support element 14J. The element 14J takes the form of an open channel section having a floor 17' and a respective side wall 20' projecting perpendicularly from each side of the floor 17'.

Each wall 20' terminates in a return fold. The support element 14J is about 70 to 130 mm wide. The walls 20' are about 35 mm high.

The inventor has found that the walls being substantially perpendicular to the floor is much stronger than the walls being divergent.

Figure 4:
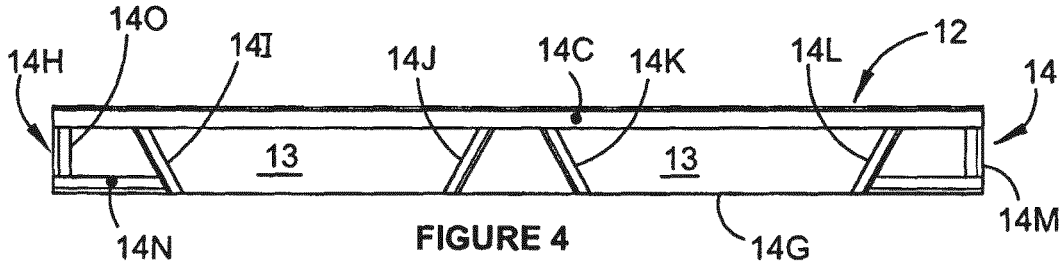
FIG. 4 is a front view of the pallet.
Figure 5:
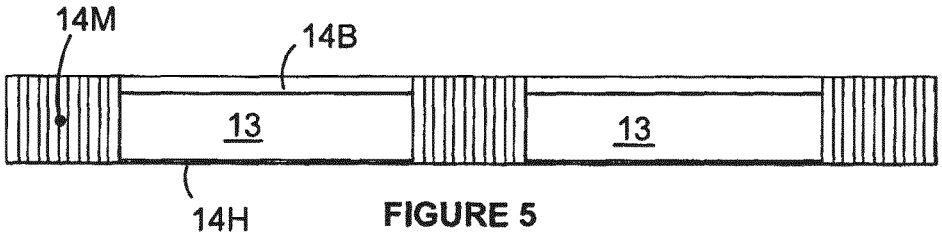
FIG. 5 is a side view of the pallet.

FIG. 4 illustrates the support elements 14H to 14M supporting the top chord 14C above the bottom chord 14G. It will be observed that in this embodiment the support elements take the form of struts and that the struts 14I, 14J (and also 14K, 14L) diverge in the upward direction. In this embodiment these support elements diverge symmetrically, each being about 60° to the horizontal. Surprisingly this outward divergence improves the load bearing characteristics of the pallet. When a weight is borne by the pallet the elements 14I, 14J define upwardly diverging load paths for transmitting the weight of the load to the ground. Due to their inclination the force applied by each of these load paths to the top and bottom chords has a horizontal component. The vertical component of the force of course matches the weight of the load. The horizontal component of the force transferred to the bottom chord 14G are resisted predominantly by frictional engagement with the ground surface rather than placing the bottom chord 14G into compression. In contrast at the upper end of the elements 14I, 14J the horizontal components of the forces transferred to the chord 14C place portions of the chord 14C intermediate the elements of 14I, 14J into tension.

So tensioning the top chord 14C has been found to increase the strength of the pallet. Without wishing to be bound by any particular theory this is thought to be related to delaying buckling of the top chord under applied loads.

This upwardly diverging construction has an additional advantage. It will also be observed that the support elements 14I, 14J define the sides of a respective tine receiving void 13. When a tine is received within the void 13 and elevated to lift the pallet, it will find the underside of the chord 14C and so "cleanly" lift the pallet 10. In contrast the inventor's experiments with upwardly converging support elements resulted in tines bearing against and riding along one or more of the inclined elements to horizontally drive the pallet when a forklift driver is simply trying to lift the pallet.

Figure 1:
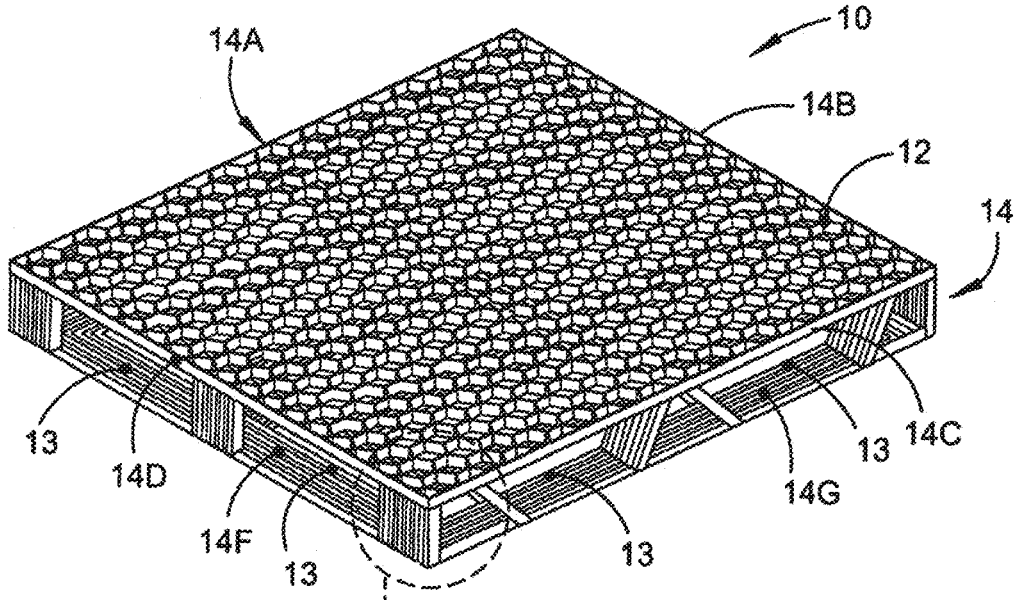
FIG. 1 is a perspective view of a pallet.
Figure 1A:
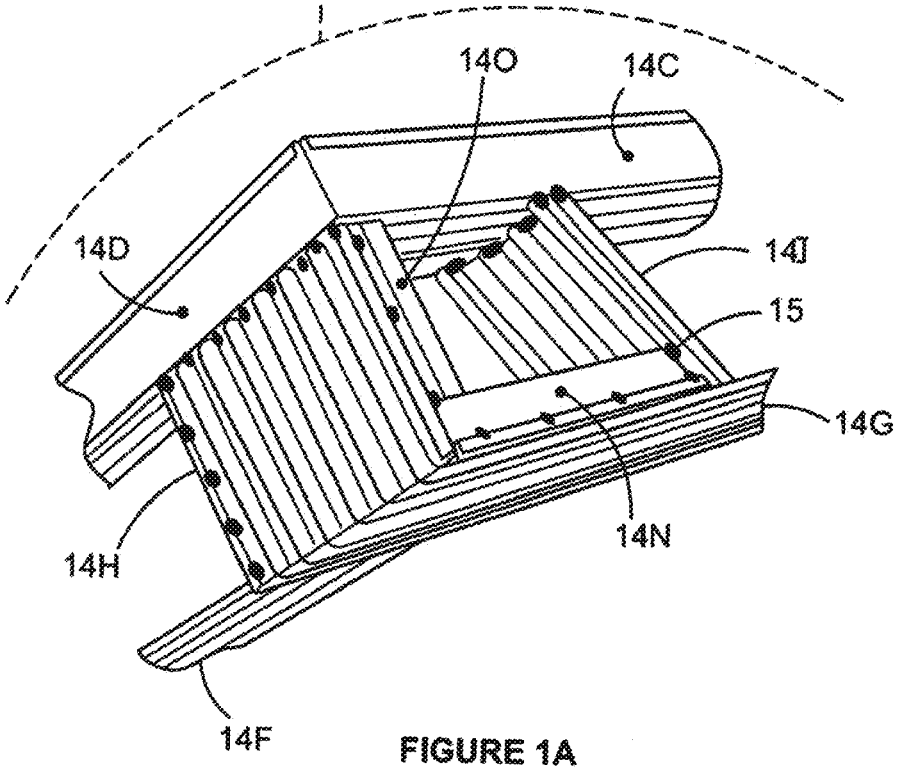
FIG. 1A is a close up view of the corner of the pallet.
Figure 2:
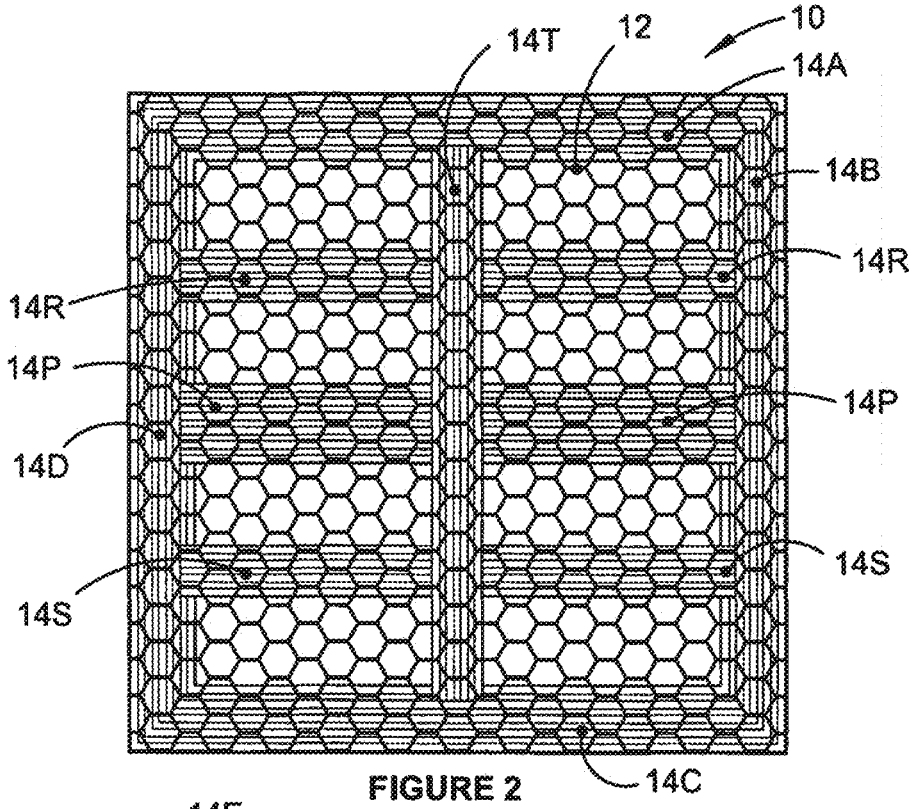
FIG. 2 is a top view of the pallet.
Figure 3:
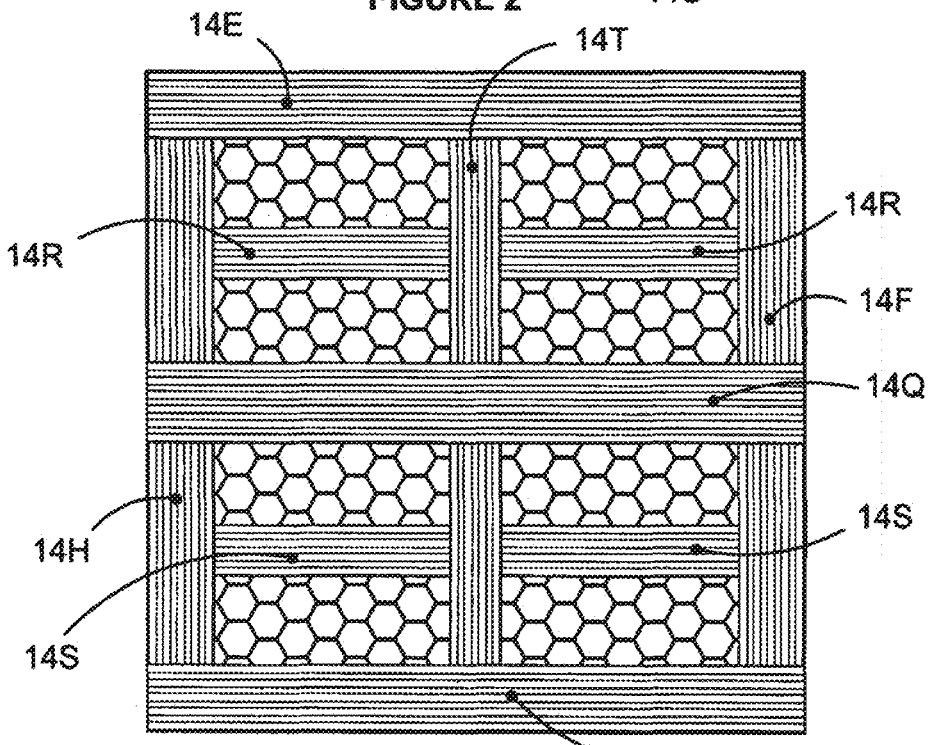
FIG. 3 is a bottom view of the pallet.

FIG. 1A shows the structure of the corner of the pallet 10 in more detail. This corner region includes support elements 14H, 14I in relatively close proximity and additional reinforcing elements 14O, 14N to strengthen this corner region. The corner region of a pallet is typically exposed to the roughest treatments, including bearing the brunt of the tines of a carelessly driven forklift.

The support element 14H is formed by an upwardly folded end portion of the bottom chord 14G. In contrast the element 14I is a separate piece held in place with a series of brazed joints 15. The reinforcing members 14N, 14O are formed of sheet material and have a similar cross-section to the support element 14I. Reinforcing element 14N is arranged so that its walls project downwardly to engage the bottom chord 14G. The reinforcing element 14N thereby defines a closed space between its "floor" and the bottom chord 14G, which space is closed at its ends by the elements 14H, 14I. The reinforcing element 14O is arranged to likewise define a closed space with the element 14H.

The location of the various brazed joints is illustrated in FIG. 1A. In this embodiment the frame 14 is formed of aluminium-zinc coated steel (in the form of BlueScope's Zincalume®) for its corrosion resistant properties. Zinc-iron coated products such as BlueScope's Zincanneal® are also suitable. The brazed joints 15 are formed using a silicone bronze braze material having a melting point in the vicinity of 1000° C. Aluminium bronze filler materials are also suitable.

The inventor has found that using low temperature braze materials leads to greatly enhanced corrosion properties without the need for post brazing treatment.

The decking 12 is constructed in line with the disclosure of the applicant's own international patent publication WO 2009/029988A1, the content of which is herein incorporated by reference.

The decking 12 is formed of painted steel strips which extend in the horizontal direction and have vertical faces. The strips are formed with spaced 60° bends about vertical axes so that when the strips are brought together in a defined pattern and welded together they define a tessellation of hexagonal cells in a honeycomb like pattern. In this embodiment the upward edge of each strip includes a short return fold. This enhances the strength of the deck and presents a smooth rounded edge to cargo carried on the deck rather than the potentially sharp free edge of the strip of material. The deck is preferably formed of cold rolled steel in the vicinity of 0.5 mm thick.

The deck may include other constructional variants as disclosed in WO 2009/029988A1.

Pallets are used for transporting goods. The specific size of the pallet is important.

Standardised sizing makes for efficient handling. Common sizes are:

| Dimensions, mm (L × W) | Dimensions, in (L × W) | Region most used in |
|---|---|---|
| 1219 × 1016 | 48.00 × 40.00 | North America |
| 1200 × 1000 | 47.24 × 39.37 | Europe, Asia |
| 1165 × 1165 | 45.87 × 45.87 | Australia |
| 1067 × 1067 | 42.00 × 42.00 | North America, Europe, Asia |
| 1100 × 1100 | 43.30 × 43.30 | Asia |
| 1200 × 800 | 47.24 × 31.50 | Europe |

North American pallets, and their metric equivalents in Europe and Asia, pack most efficiently into standard shipping containers.

Elongate members in accordance with the invention may take the form of "Hat" profiles. Hat profiles are used for battens on roofs. Other embodiments of the invention may take the form of rectangular hollow sections. By way of example, two members per FIG. 6 might be brought together and brazed, or otherwise fastened, to form a rectangular hollow section. Four such sections may be joined end to end to form a perimeter frame of a pallet.

Figure 9:
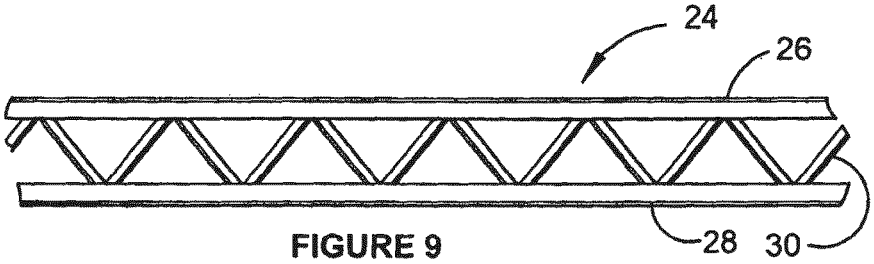
FIG. 9 is a side view of a portion of a truss.

FIG. 9 illustrates a portion of a truss 24 in accordance with another embodiment of the invention. A truss is a form of frame in which straight elongate members are connected at nodes, and the members are arranged such that loads applied to the nodes are resisted at least predominantly (ideally entirely) by tension or compression in the members (rather than a bending moment within any one member).

The truss 24 includes horizontally extending top and bottom chords 26, 28 interconnected by a series of inclined struts 30 arranged in a horizontally extending zigzag pattern. The truss 24 may find application as, for example, a floor joist in a residential building.

The inventor has discovered that the load bearing characteristics of a truss can be enhanced by the inclusion of "ultra low corrugations" similar to those described in respect of the embodiment of FIGS. 1 to 8. In particular the characteristics can be improved by including the corrugations in a side wall, or walls, of one or both of the top and bottom chords 26, 28.

Figure 10:
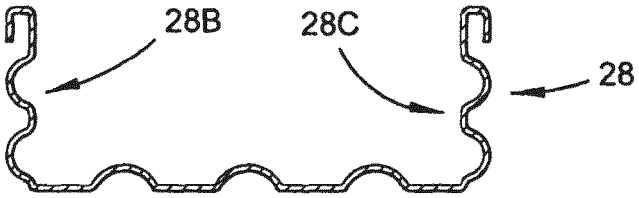
FIG. 10 is a transverse cross-section view of a bottom chord of the truss.

FIG. 10 illustrates a transverse cross-section view of the bottom chord 28. The chord 28 includes a horizontal floor 28A including lengthwise ultra low corrugations, and at each side of the floor 28A a respective side wall 28B, 28C projecting perpendicularly to the floor 28A to define an open channel section. Each of the walls 28B, 28C includes ultra low corrugations and terminates in a short return flange.

Without wishing to be bound by any particular theory the inventor has observed that previously existing frames incorporating open channel sections frequently fail under load when the side walls of the section buckle, often buckling by bulging outwardly. The inclusion of ultra low corrugations along the side walls 28B, 28C are thought to delay this failure mode under applied load thereby increasing the strength of the truss 24 for minimal additional cost or weight. Moreover, as described in respect of the earlier embodiment the inclusion of the inventor's ultra low corrugations in cold rolled steel can produce an elongate member having a strength equivalent to a thickness of cold rolled steel not regularly commercially available (or at least not economically so).

Figure 11:
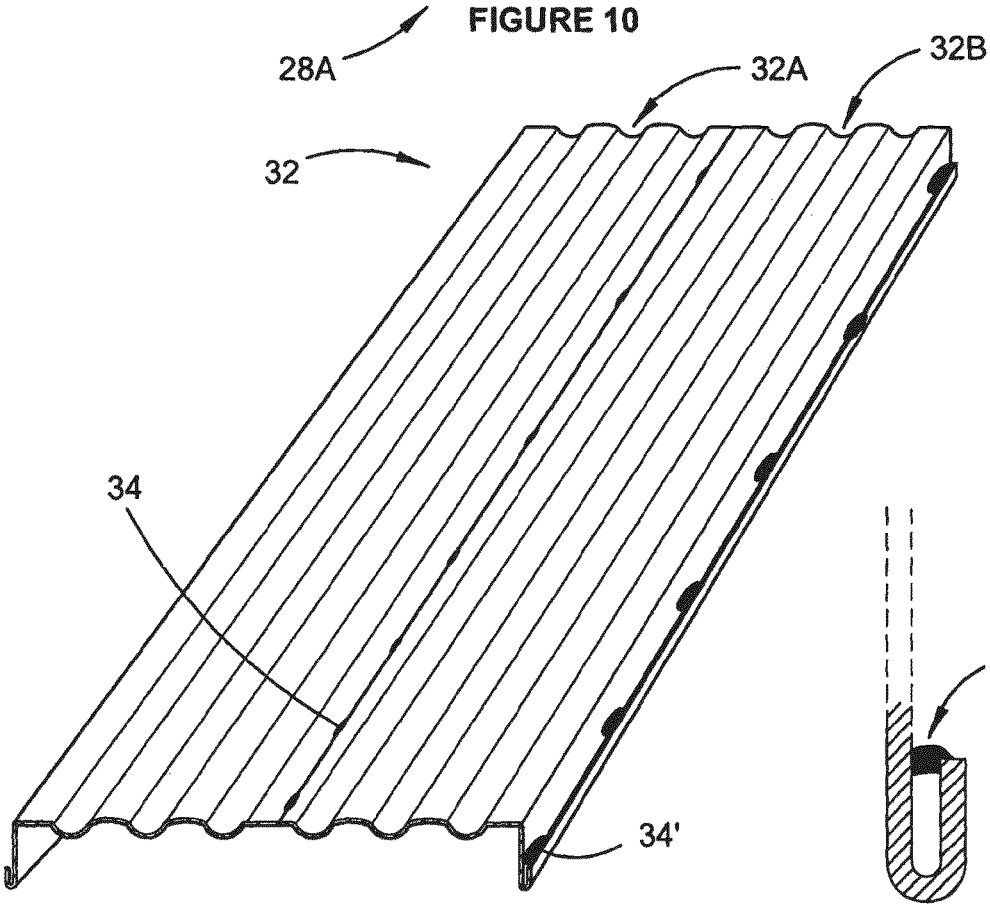
FIG. 11 is a perspective view of an elongate member.

FIG. 11 illustrates a member 32 in accordance with a further embodiment of the invention. The previously described embodiments included elongate members formed of a single integral web of material. The member 32 consists of a web of material made up of parallel elongate web portions 32A, 32B joined at longitudinally spaced brazed joints 34. The member 32 further includes a pair of side walls which each terminate in a return fold. Brazed joints 34' spaced longitudinally along each return fold fasten the free edge of the web of material to the main body of the wall.

Figure 12:
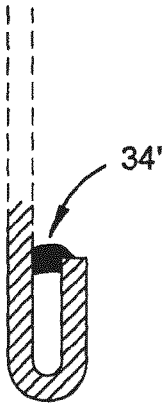
FIG. 12 is a transverse cross-section view of a return fold.

FIG. 12 illustrates a brazed joint 34' in which filler material bridges a gap defined by a return fold.

Figure 13:
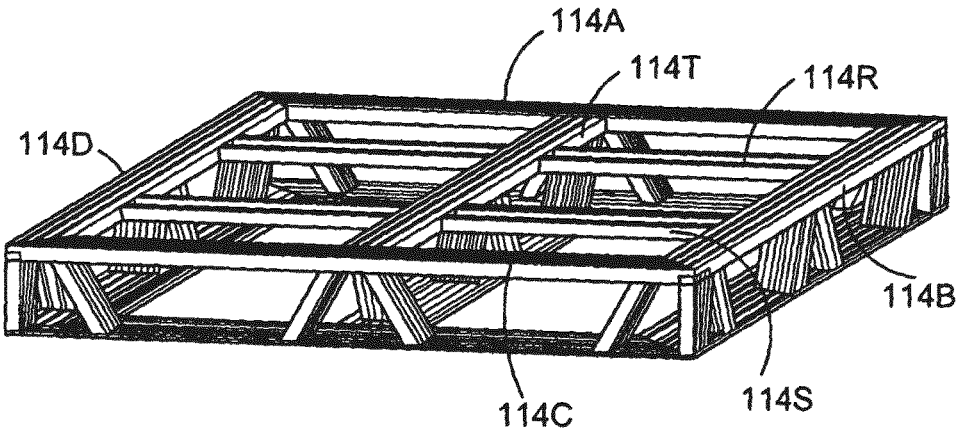
FIG. 13 is perspective view of another pallet.

FIG. 13 illustrates an exemplary pallet in which the members 114A, 114B, 114C and 114D (which define a frame about a perimeter of the pallet) take the form of tubular portions. The frame is spanned longitudinally by tubular member 114T to define a pair of longitudinally extending transversely spaced regions. Each of these regions are spanned by corrugated sheet material which is about 0.48 mm thick and has an approximately sinusoidal profile (not shown). The corrugations of the profile are about 6 mm high (peak to trough).

Under the sheet material, each of the regions either side of the member 114T is transversely spanned by a pair of members 114R, 114S. The members 114R, 114S take the form of an upwardly open channel and are closed by the sheet material.

The members 114A, 114B, 114C, 114D, 114R, 114S, 114T and the sheet material are brazed together and together constitute a deck for carrying cargo. The corrugated surface has been found to contribute to load stability by providing sliding resistance to bags, cardboard boxes and other cargo.

Figure 14:
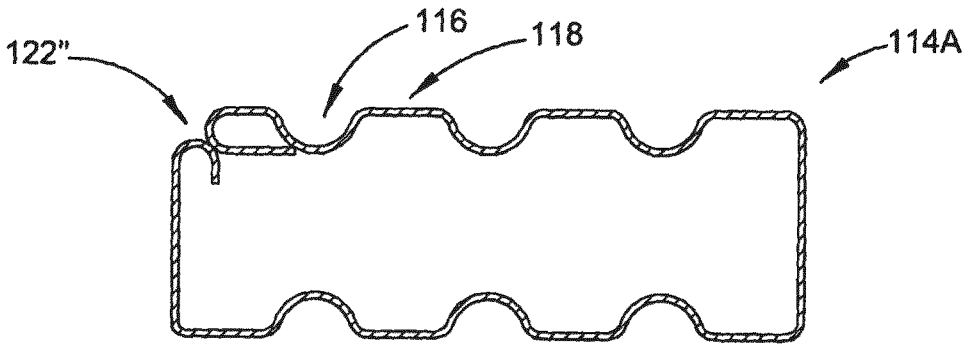
FIG. 14 is transverse cross-section view of a tubular portion of a frame.

FIG. 14 is a transverse cross-section view of one of these tubular portions. In this embodiment, each tubular portion is roll-formed from a continuous sheet of material and then parted off and mitred. The mitred ends of the tubular portions are brazed together using a low temperature braze material. Such low temperature brazes have been found to have good resistance to vibration and impact loading.

As an alternative to parting off the tubular portions, an integral perimeter may be formed by cutting suitable triangular cut-outs along a single length of tube.

The tubular portions have a rectangular cross-section including a pair of walls vertically spacing a floor and ceiling. Each of the floor and the ceiling include inwardly directed lengthwise corrugations 116 spacing aligned outward planar portions 118. Without intermediate projections, the planar portions 118 can mate with planar or linear elements of other parts such as the short vertical struts which support the frame.

During the roll forming operation to create the portion 114A, a strip of material is deformed about its long axis to define a closed tubular shape, which in the illustrated variant is rectangular. Respective lengthwise portions of the strip are brought together and bonded to form a lengthwise seam.

The described variant of the strip is 0.48 mm thick steel. Typically steels of this thickness are not well suit to welding, brazing or other forms of energetic bonding. Accordingly, in this variant, the free edges for the strip are formed to include return folds (i.e. folds in the vicinity of 180°) and the curved exteriors of the return folds are brought together and bonded to form a lengthwise seem. This reduces the risk of "burning away" material which may be problematic if attempting to weld to two free edges.

As a further option, vertical stripes of braze may be applied to the walls of the members 114A, 114B, 114C and 114D which face outwardly from the pallet. The stripes are preferably spaced at a pitch of 50 to 60 mm and serve to reinforce these outer walls against damage, e.g. to reinforce against penetration by misdirected forklift tines. The pallet of FIG. 13 is predominantly formed of "bare" steel (i.e. steel without any form of coating) to which a rust inhibiting coating in the form of a food grade powder coating is applied after the brazing operation. Desirably the powder coating covers the base material and the braze material in a continuous outer layer. The powder coating tends to fill any sharp corner and/or voids, e.g. about the brazed joints, thus making the pallet easier to clean.

Preferred forms of the pallet include a plastic panel to which an RFID tag is adhesively bonded. The inventor has found that by mounting the tag on a plastic component and spacing the tag from metallic components, simple low-cost adhesively attachable tags can work effectively on metal structures. Most preferably the panel is a carried within between struts at an edge of the pallet so that the struts protect the panel and the tag from damage yet the tag is accessible for reading.

The invention claimed is:

1. A method of moving a pallet, the method comprising selecting a pallet comprising:

two side edges;

two end edges;

a horizontally extending member running along one of the end edges; elements for supporting the horizontally extending member above a support surface to define two openings spaced from each other so as to facilitate receiving tines of a forklift;

one of the openings having sides defined by two of the elements, the two of the elements defining upwardly diverging load paths such that weight carried by the pallet tensions a portion of the horizontally extending member intermediate the two of the elements; and the other of the openings having sides defined by another two of the elements, the other two of the elements defining upwardly diverging load paths such that weight carried by the pallet tensions a portion of the horizontally extending member intermediate the other two of the elements;

a respective further element at each of the side edges to further support the horizontally extending member above the support surface, wherein each of the further elements is upwardly directed, the two of the elements and the other two of the elements being inward of the respective further element with respect to the side edges; and inserting the tines of the forklift into the openings.

2. A method of moving a pallet, the method comprising:

selecting a pallet comprising:

two side edges;

two end edges;

a horizontally extending member running along one of the end edges;

elements for supporting the horizontally extending member above a support surface to define two openings spaced from each other to facilitate receiving tines of a forklift;

one of the openings having sides defined by two of the elements, the two of the elements upwardly diverging from each other; and the other of the openings having sides defined by another two of the elements, the other two of the elements upwardly diverging from each other;

a respective further element at each of the side edges to further support the horizontally extending member above the support surface, wherein each of the further elements is upwardly directed, the two of the elements and the other two of the elements being inwardly of the respective further element with respect to the side edges; and inserting the tines of the forklift into the openings.

3. A pallet comprising:

two side edges;

two end edges;

a horizontally extending member running along one of the end edges; elements for supporting the horizontally extending member above a support surface to define two openings for receiving tines of a forklift;

one of the openings having sides defined by two of the elements, the two of the elements defining upwardly diverging load paths such that weight carried by the pallet tensions a portion of the horizontally extending member intermediate the two of the elements;

the other of the openings having sides defined by another two of the elements, the other two of the elements defining upwardly diverging load paths such that weight carried by the pallet tensions a portion of the horizontally extending member intermediate the other two of the elements; and a respective further element at each of the side edges to further support the horizontally extending member above the support surface, wherein each of the further elements is upwardly directed, the two of the elements and the other two of the elements being inwardly of the respective further element with respect to the side edges.

4. The pallet of claim 3 wherein the horizontally extending member is an elongate member.

5. The pallet of claim 3 wherein the horizontally extending member is tubular.

6. The pallet of claim 3 wherein the horizontally extending member includes an upwardly projecting portion shaped to cooperate with an upwardly adjacent like pallet for aligned stacking.

7. The pallet of claim 3 wherein the horizontally extending member substantially consists of formed sheet metal.

8. The pallet of claim 7 wherein the horizontally extending member includes lengthwise corrugations.

9. The pallet of claim 3 comprising an elongate member underlying at least one of the openings; and wherein the elongate member includes a body having lengthwise corrugations.

10. The pallet of claim 9 wherein each side of the body respectively includes a portion formed to overlap a portion of the body.

11. The pallet of claim 10 wherein the overlapping portion is fastened along its length to the body.

12. A pallet comprising:

two side edges;

two end edges;

a horizontally extending member running along one of the end edges; elements for supporting the horizontally extending member above a support surface to define two openings for receiving tines of a forklift;

one of the openings having sides defined by two of the elements, the two of the elements upwardly diverging from each other;

the other of the openings having sides defined by another two of the elements, the other two of the elements upwardly diverging from each other; and a respective further element at each of the side edges to further support the horizontally extending member above the support surface, wherein each of the further elements is upwardly directed, the two of the elements and the other two of the elements being inwardly of the respective further element with respect to the side edges.

13. The pallet of claim 12 wherein the horizontally extending member is an elongate member.

14. The pallet of claim 12 wherein the horizontally extending member is tubular.

15. The pallet of claim 12 wherein the horizontally extending member comprises an upwardly projecting portion shaped to cooperate with an upwardly adjacent like pallet for aligned stacking.

16. The pallet of claim 12 wherein the horizontally extending member substantially consists of formed sheet metal.

17. The pallet of claim 16 wherein the horizontally extending member comprises lengthwise corrugations.

18. The pallet of claim 12 including an elongate member underlying at least one of the openings; and wherein the elongate member comprises a body having lengthwise corrugations.

19. The pallet of claim 18 wherein each side of the body respectively comprises a portion formed to overlap a portion of the body.

20. The pallet of claim 19 wherein the overlapping portion is fastened along its length to the body.

* * * * *